US007347593B1

(12) United States Patent
Swanson

(10) Patent No.: US 7,347,593 B1
(45) Date of Patent: Mar. 25, 2008

(54) GICLEE PRINTED LAMP SHADE, METHOD OF MAKING THE SAME, AND DO IT YOURSELF LAMP SHADE KIT

(75) Inventor: Dennis K. Swanson, Woodland Hills, CA (US)

(73) Assignee: Lamps Plus, Inc., Chatsworth, CA (US)

( * ) Notice: Subject to any disclaimer, the term of this patent is extended or adjusted under 35 U.S.C. 154(b) by 0 days.

(21) Appl. No.: 11/525,743

(22) Filed: Sep. 22, 2006

(51) Int. Cl.
*F21V 1/16* (2006.01)

(52) U.S. Cl. ..... 362/357; 362/351; 40/554; 40/768

(58) Field of Classification Search ..... 362/351–361; 40/554, 768
See application file for complete search history.

(56) References Cited

U.S. PATENT DOCUMENTS

| | | | | |
|---|---|---|---|---|
| 1,459,715 | A | 6/1923 | Bliss | |
| 1,567,742 | A | 12/1925 | Lozano | |
| 1,580,922 | A | 4/1926 | Scherer | |
| 1,583,568 | A | 5/1926 | Berkowitz | |
| 2,224,950 | A | 12/1940 | Burke | |
| 2,680,317 | A | 6/1954 | Lewis | |
| 3,456,106 | A | 7/1969 | Gluschkin | |
| 4,068,120 | A | 1/1978 | Throckmorton et al. | |
| 4,163,998 | A | 8/1979 | Anderson et al. | |
| 4,212,052 | A | 7/1980 | Chambard | |
| 4,268,896 | A | 5/1981 | Mann | |
| 4,452,839 | A | 6/1984 | Worden | |
| 4,731,715 | A | 3/1988 | Anderson | |
| 5,134,559 | A | 7/1992 | Ruskin | |
| 5,211,474 | A | 5/1993 | Leitner et al. | |
| 5,662,412 | A | 9/1997 | Glendmyer | |
| 5,746,506 | A | 5/1998 | Dunbar | |
| 6,189,251 | B1 * | 2/2001 | Wilson | 40/768 |
| 6,729,747 | B1 | 5/2004 | Wirayani | |
| 6,736,530 | B2 | 5/2004 | Thevenot | |
| 6,786,621 | B2 | 9/2004 | Sviland | |
| 6,857,766 | B2 | 2/2005 | Verdi | |
| 2003/0081418 | A1 * | 5/2003 | Sviland | 362/356 |
| 2004/0148231 | A1 | 7/2004 | Ximenes et al. | |
| 2005/0016667 | A1 | 1/2005 | Dwight et al. | |
| 2006/0050517 | A1 | 3/2006 | LaFleiche et al. | |

FOREIGN PATENT DOCUMENTS

| | | |
|---|---|---|
| DE | 198 28 860 A 1 | 9/1999 |
| GB | 1244916 | 9/1970 |
| GB | 2 190 480 A | 11/1987 |
| GB | 2 273 261 A | 6/1994 |
| WO | WO 94/01290 | 1/1994 |

* cited by examiner

*Primary Examiner*—Stephen F. Husar
(74) *Attorney, Agent, or Firm*—Billy A. Robbins; Connolly, Bove, Lodge & Hutz LLP

(57) ABSTRACT

A Giclee printed lamp shade and method of making the same which includes a lamp shade having a frame having a top and bottom of the same geometric configuration and dimensions to provide flat sides thereto. A Giclee printed fine art canvas material is permanently adhesively secured to base material which is affixed to the lamp shade frame. The Giclee printing is accomplished by providing a digital image to be printed on the canvas, providing a printer capable of accomplishing the Giclee printing, imparting the digital image to the Giclee printer, Giclee printing the image on the canvas material and securing the canvas bearing the Giclee printed image to the outer surface of the lamp shade.

9 Claims, 3 Drawing Sheets

GICLEE PRINTED LAMP SHADE, METHOD OF MAKING THE SAME, AND DO IT YOURSELF LAMP SHADE KIT

FIELD OF THE INVENTION

The present invention relates to lamps and more particularly to lamp shades and methods for manufacturing lamp shades utilizing Giclee printed material.

BACKGROUND OF THE INVENTION

Lamps and lamp shades are well-known and widely used in a variety of settings to provide lighting requirements in a specified area. Lamps are available in a wide variety of configurations, including floor lamps, desk lamps, table lamps, wall lamps and hanging shade pendants each of which has many and various configurations. A typical lamp irrespective of the type which is involved includes as an integral part thereof a lamp shade. Lamp shades are very often selected for their decorative appearance. As a result, lamp shades have been made available in a wide variety of different styles utilizing different materials of construction, as well as differing shapes and sizes. Various colors and decorative patterns have been used on the lamp shades in some instances, including hand painted scenes, photographs, various decorative designs, and the like. Applicant, however, is unaware of any lamp shades which have used Giclee printed material as the decorative portion for the lamp shade.

SUMMARY OF THE INVENTION

A Giclee printed lamp shade including a frame having a top and bottom having the same geometric configuration and dimensions. A base material affixed to the frame to provide a flat surface between the top and bottom of the frame and a canvas material having an image Giclee printed thereon permanently secured to the base material.

A method of manufacturing a lamp shade comprising providing a canvas material, providing a digital image to be printed on the canvas material, providing a printer capable of accomplishing Giclee printing, imparting the digital image to the Giclee printer, Giclee printing the image on the canvas material and securing the canvas bearing the Giclee printed image to the outer surface of a lamp shade.

DETAILED DESCRIPTION

The present invention is directed to a lamp shade which is decorated on its exterior surface by Giclee printing a desired decorative image. The image may be any which is desired, such as fine art, family photographs, vacation scenes or the like which are particularly memorable. Giclee printing of images generated from high resolution digital images and printed with archival quality inks provides a lamp shade constructed in accordance with the present invention. The Giclee printing is onto a canvas which has been appropriately treated to receive the archival quality ink and to reproduce the image in high resolution. Giclee printing is typically accomplished using professional 8 color to 12 color ink jet printers. These printers are available commercially from such companies as Epson, MacDermid Colorspan and Hewlett Packard. The digital images desired for decoration of the lamp shade may be used on a one-time basis or alternatively, may be digitally archived so that they can be retrieved at a later time and used again should the owner of the image desire to do so for additional lamp shades. Utilization of the Giclee printing allows one to capture the digital image and then have an opportunity to edit the image. Although the image can be obtained by scanning an existing photograph or transparency, better quality is obtained through utilization of an image generated by a digital camera. The most important element of Giclee printing is the digital file and therefore the highest quality digital image is the most desirable to obtain the best decorative image on the lamp shade. In accordance with the present invention, the digital image is printed by the Giclee printer utilizing archival inks upon a fine art canvas which is typically a cotton canvas with a neutral pH factor and a low dot gain and may have either a gloss or a matte finish as desired.

Figure 1:
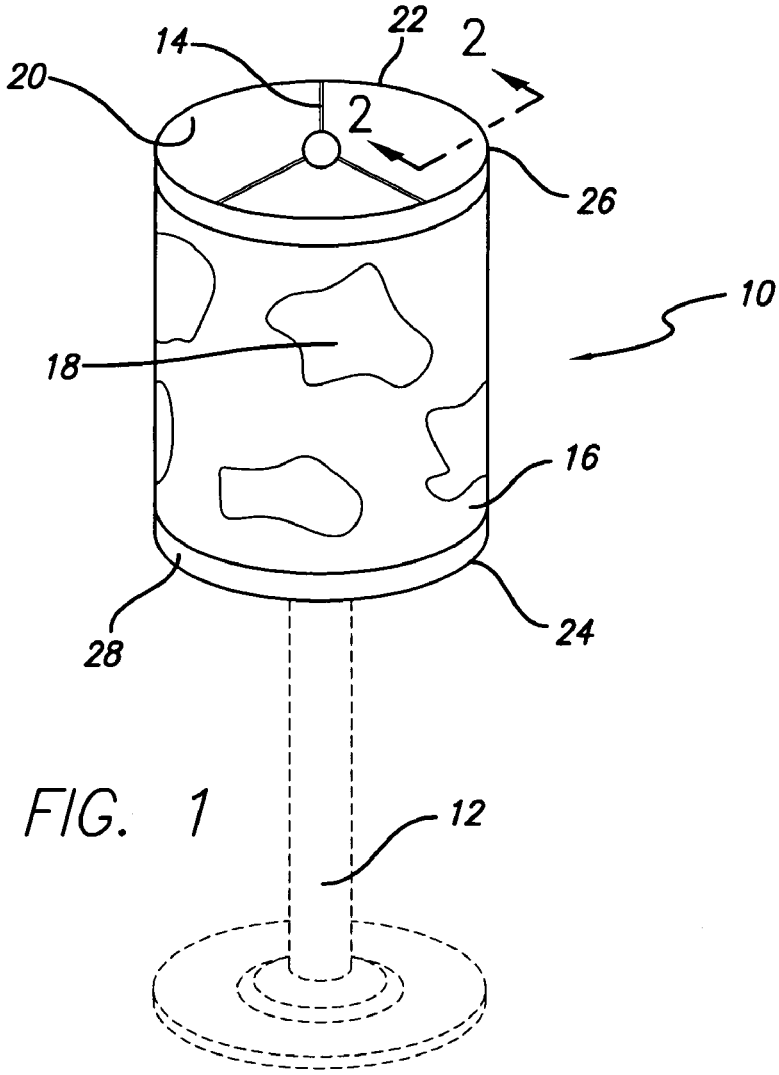
FIG. 1 is a perspective view of a completed lamp shade positioned upon a lamp.

Referring now to the drawings and more particularly to FIG. 1, there is shown a Giclee printed lamp shade 10 which is affixed to a lamp. The lamp is shown generally at 12 in dashed lines which is indicative of the fact that even though FIG. 1 illustrates the inventive lamp shade on a table lamp, the lamp shade may be affixed to and become part of any type of lamp desired such as a desk lamp, floor lamp, or the like. The Giclee printed lamp shade includes a wire frame 14 which is well known in the art and is used to maintain the geometric configuration of the lamp shade and to secure the lamp shade to the desired lamp. The present invention is directed to a canvas 16 which contains Giclee printed images 18 thereon which canvas is permanently secured to a base material 20 that is secured to the frame 14. In accordance with a preferred embodiment of the present invention, the frame 14 has a top 22 and a bottom 24. The top and the bottom preferably have the same geometric configuration and dimensions so that the base material 20 when affixed to the frame provides a flat surface between the top and the bottom. Such a flat surface facilitates the application of the Giclee printed canvas 16 to the exterior surface of the base material 20. Once the canvas 16 bearing the Giclee printed images 18 is affixed to the base material 20, appropriate trim tape as shown at 26 and 28 may be applied to the top and bottom to finish the appearance and to cover any irregularities that may occur in the outer edges of the canvas 16. If desired, the trim tape 24 and 26 may be dimensioned so as to extend over the top and bottom of the base material after which it may be rolled over and affixed to the back side of the base material 20.

Figure 2:
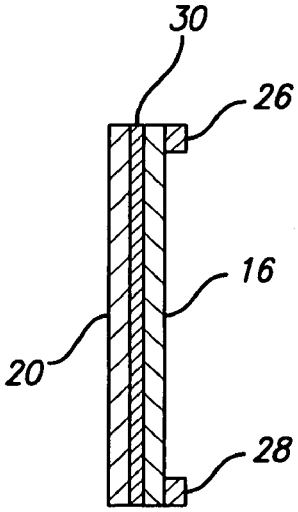
FIG. 2 is a cross-sectional view of the lamp shade of FIG. 1 taken about the lines 2-2 thereof.

Referring now more particularly to FIG. 2, the construction of the lamp shade 10 is illustrated in cross-section. As shown therein, the base material 20 has the Giclee printed canvas 16 permanently secured to the outer surface of the base material 20 by a layer of adhesive 30 which adheres to the back surface of the canvas 16 and to the outer surface of the base material 20. The adhesive 30 may be any which is known to the art for adhesively securing canvas to a base material. The base material 20 may be fabric or alternatively, may be other material such as a plastic material that will accept an adhesive. As is shown, the trim tape 24 and 26 is applied along the upper and lower edges of the Giclee printed canvas 16.

Figure 3:
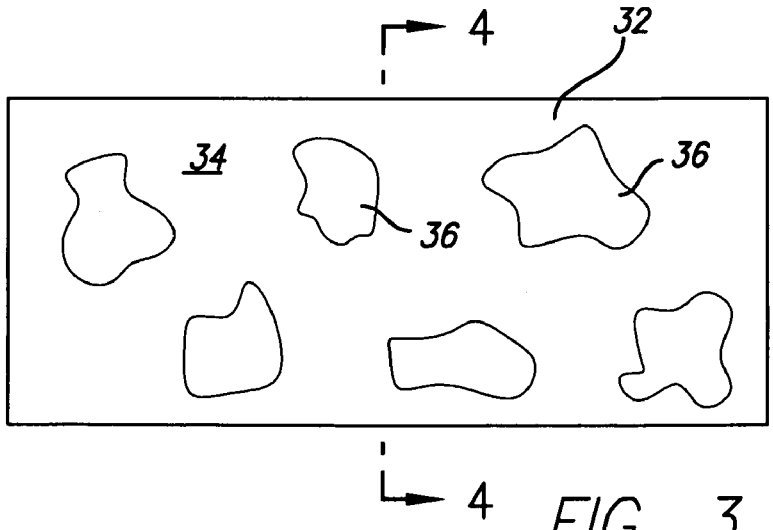
FIG. 3 is a plan view of a canvas bearing a Giclee printed image.
Figure 4:
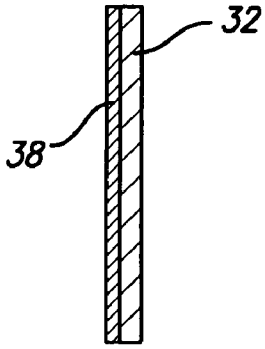
FIG. 4 is a cross-sectional view of the canvas as shown in FIG. 3 taken about the lines 4-4 thereof.
Figure 5:
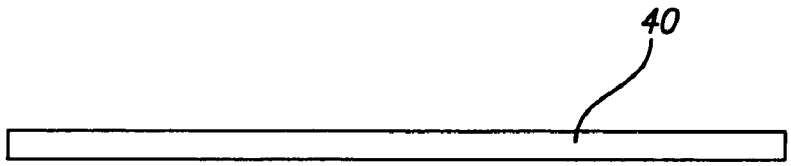
FIG. 5 is a plan view of a decorative tape applied to the lamp shade as shown in FIG. 1.

As is illustrated in FIG. 3, a section of canvas material 42 is provided. Preferably, the surface 34 of the material 32 is treated with a surface coating to provide the desired pH factor and to prime the surface 34 to accept the archival ink from the Giclee printer. Subsequent to the appropriate treatment of the surface 34, the canvas 32 is then positioned adjacent a Giclee printer which has been programmed to spray the archival ink in accordance with the digital image desired to be reproduced on the lamp shade 10. The Giclee printer then sprays the archival ink to produce the image as shown at 36 on the surface 34 of the canvas 32. As is shown in FIG. 4, the canvas 32 after being printed with the image 36 is then coated with an adhesive layer 38 which is utilized to affix the canvas 32 to the base material as illustrated in FIG. 2 and above described. As is shown in FIG. 5, a trim tape 40 which may have any desired configuration, color, and texture is applied as shown at 26 and 28 in FIG. 1 to the top and bottom edges of the Giclee printed canvas.

Figure 6:
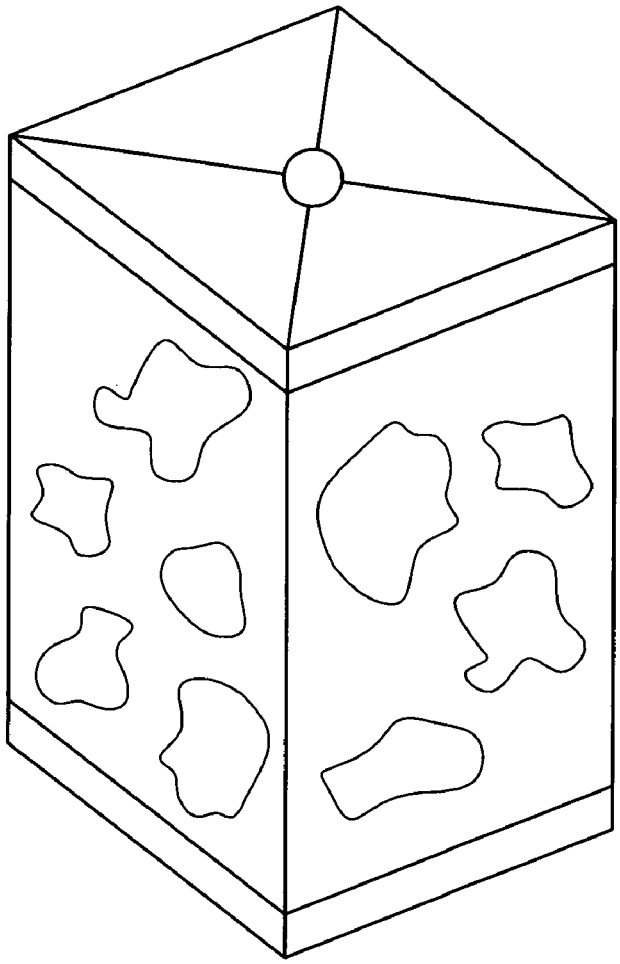
FIG. 6 is a perspective view of a lamp shade having an alternative geometric configuration from that shown in FIG. 1.

The lamp shade 10 may have any geometric configuration desired but as above indicated it is preferably that it be constructed to have flat surfaces to facilitate the adhesive securement of the Giclee printed canvas to the outer surface of the lamp shade. An alternative geometric configuration to that shown in FIG. 1 is illustrated in FIG. 6 which illustrates rectangular sides. Although a four-sided structure is shown in FIG. 6, it will be recognized by those skilled in the art that any number of sides may be generated depending upon the decorative appearance desired by the lamp shade.

Figure 7:
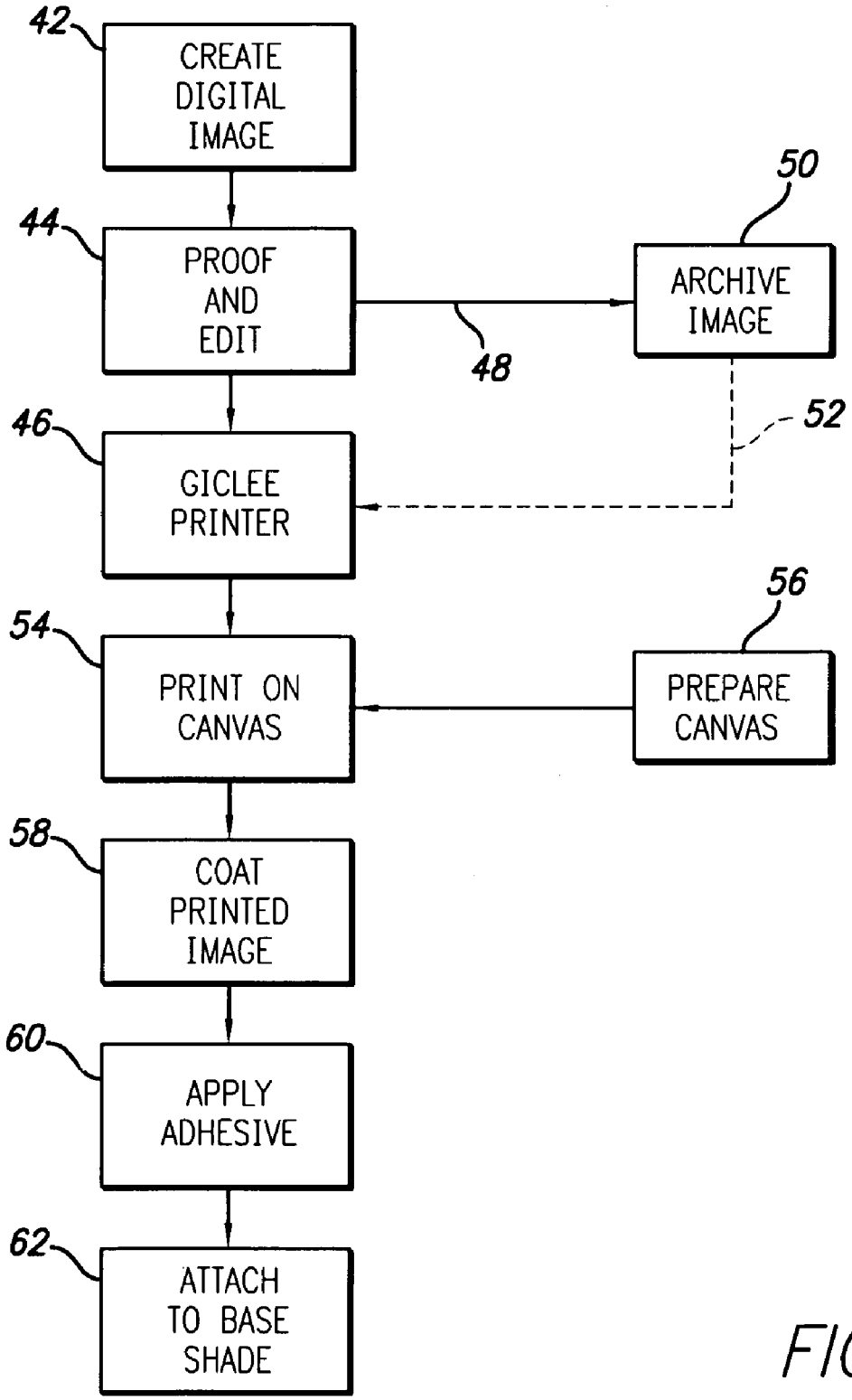
FIG. 7 is a flow chart illustrative of the method of creating a Giclee printed lamp shade of the present invention.

Referring now more particularly to FIG. 7, there is illustrated a flow diagram of the various steps taken in creation of the Giclee printed lamp shade as shown in FIGS. 1 through 6 and above described. As is shown, the first step 42 is to create a digital image as above described. Preferably, the digital image will be created through the utilization of a digital camera in order to provide the highest quality digital image possible to accomplish the Giclee printing. However, in the event that the digital image is not available through the utilization of a digital camera, the desired image from a photograph or fine art work may be created by a digital scanning as is well known in the art. Once the digital image has been created, it may then be observed for proofing and editing 44. As is often the case, there may be extraneous material in the digital image which it is not desired to reproduce on the Giclee printed lamp shade. Thus, at this point the image may be edited and proofed to assure that it is exactly what is desired on the finished product. The proofed and edit image may then be transmitted to the Giclee printer 46 for appropriate processing. Alternatively, as indicated at 48, the proofed and edited digital image may be transmitted to a digital archive 50 where it may be maintained for future use by the customer who owns the digital image should such be desired. Where such is the case, and the customer wishes to have an archived digital image utilized instead of the image being transmitted directly after the proof and editing, it may be retrieved from the digital archive as shown at 52 and submitted to the Giclee printer 46. The Giclee printer after receipt of the desired digital image is then programmed to print the image on a canvas substrate 54. Prior to printing on the canvas substrate, however, the canvas substrate is appropriately prepared as shown at 56 by applying the desired surface treatment thereto so that the surface of the canvas is properly prepared to accept and retain on a permanent basis the archival ink digitally printed Giclee image. It is desirable that once the image is printed by the Giclee printer on the canvas, that the image be coated as shown at 58 to protect it in the event that the image is exposed to sunlight, moisture or other elements which could possibly deteriorate the image quality. Once the Giclee printed image has been coated, then an appropriate adhesive is applied to the reverse surface of the printed canvas as shown at 60 and the Giclee printed canvas is then permanently, adhesively secured to the base shade as shown at 62 to provide the Giclee printed lamp shade as shown in FIG. 1. As above indicated, the trim tape 26 and 28 would then be applied to the top and bottom of the canvas to complete the Giclee printed lamp shade.

There has thus been disclosed a lamp shade which is decorated through the utilization of Giclee printing onto a canvas which canvas is then permanently and adhesively secured to a lamp shade base and the method of making the same. Modifications and equivalents of the disclosed concepts may occur to one skilled in the art and such are intended to be included within the scope of the present invention.

What is claimed is:

1. A lamp shade comprising:

a frame member adapted for attachment to a lamp, said frame member having a top and bottom, said top and bottom having substantially the same geometric configuration and dimensions to define a member surrounding an illumination element of a lamp;

a base material affixed to the top and bottom of said frame to provide a flat surface between said top and bottom; and a canvas material having an image Giclee printed thereon, permanently secured to said base material.

2. A Giclee printed lamp shade as defined in claim 1, wherein said canvas material is adhesively secured to said base material.

3. A Giclee printed lamp shade as defined in claim 2, wherein said Giclee printed image is printed using archival quality inks.

4. A Giclee lamp shade as defined in claim 1, which further includes trim tape secured to edges of said canvas adjacent the top and bottom of said frame.

5. A Giclee printed lamp shade as defined in claim 4, wherein said trim tape is adhesively secured to said canvas and is rolled over the edges of said canvas and is secured to said base material.

6. A method of making a Giclee printed lamp shade comprising the steps of:

creating a digital image from decorative material to be applied to the exterior of a lamp shade;

proofing and editing the digital image;

coupling the digital image to a Giclee printer;

Giclee printing the digital image onto the surface of fine art canvas;

applying an adhesive to the surface of the canvas opposite that upon which the digital image has been Giclee printed;

and attaching the Giclee printed fine art canvas to the surface of a base lamp shade.

7. The method as defined in claim 6, which further includes surface treating the fine art canvas prior to Giclee printing the image thereon.

8. The method as defined in claim 7, which includes the further step of coating the Giclee printed image with a protective coating.

9. The method as defined in claim 6, which includes the further step of archiving the edited digital image in a digital archive.

* * * * *